US010909948B2

(12) United States Patent
Chen et al.

(10) Patent No.: US 10,909,948 B2
(45) Date of Patent: Feb. 2, 2021

(54) UBIQUITOUS AUTO CALIBRATION DEVICE AND THE CALIBRATION METHOD THEREOF

(71) Applicant: DIVA LABORATORIES, LTD., New Taipei (TW)

(72) Inventors: Chih-An Chen, New Taipei (TW); Wei-Peng Wang, New Taipei (TW); Ching-Min Huang, New Taipei (TW); Tzu-Hui Lee, New Taipei (TW); Chuan-Ling Peng, New Taipei (TW); Chi-Chou Huang, New Taipei (TW); Huei-Jiun Li, New Taipei (TW); Mei-Chuan Ku, New Taipei (TW)

(73) Assignee: Diva Laboratories, Ltd., New Taipei (TW)

( * ) Notice: Subject to any disclaimer, the term of this patent is extended or adjusted under 35 U.S.C. 154(b) by 0 days.

(21) Appl. No.: 16/557,103

(22) Filed: Aug. 30, 2019

(65) Prior Publication Data

US 2020/0365113 A1 Nov. 19, 2020

(30) Foreign Application Priority Data

May 16, 2019 (TW) ..... 108116842 A

(51) Int. Cl.
*G09G 5/02* (2006.01)

(52) U.S. Cl.
CPC ..... *G09G 5/02* (2013.01); *G09G 2320/0242* (2013.01); *G09G 2320/0666* (2013.01);
(Continued)

(58) Field of Classification Search
None
See application file for complete search history.

(56) References Cited

U.S. PATENT DOCUMENTS

2004/0196250 A1* 10/2004 Mehrotra ..... H04N 9/73 345/102
2006/0280360 A1* 12/2006 Holub ..... H04N 17/045 382/162

(Continued)

*Primary Examiner* — Patrick F Valdez
(74) *Attorney, Agent, or Firm* — Muncy, Geissler, Olds & Lowe, P.C.

(57) ABSTRACT

A ubiquitous auto calibration device is provided, which includes microcontroller unit, flex bus, image receiver image processing module, and an image output unit. The microcontroller unit is provided for receiving the electronic signal and performing a self-adjusting process to the electronic signal. The flex bus is connected with the microcontroller unit, and is provided for transmitting the electronic signal to the image processing module after performing the self-adjusting process. The image receiver is provided for receiving the image signal from the image receiving interface. The image processing module is provided for performing an image calibration process to the image signal, so that the image signal can obey the color temperature standard, Gamma value, uniformity and color gamut standards when the panel outputs the image signal. The image output unit is connected with the panel and is provided for transmitting the electronic signal which is adjusted by the self-adjust process and the image signal which is adjusted by the image calibrating process, such that the panel can perform calibration process according to the electronic signal by the self-adjusting process and output the image signal processed by the image calibrating process.

7 Claims, 12 Drawing Sheets

(52) U.S. Cl.
CPC ..... *G09G 2320/0673* (2013.01); *G09G 2320/0693* (2013.01); *G09G 2360/145* (2013.01); *G09G 2380/08* (2013.01)

(56) References Cited

U.S. PATENT DOCUMENTS

| | | | | |
|---|---|---|---|---|
| 2007/0052735 | A1* | 3/2007 | Chou | G09G 3/2003 345/690 |
| 2009/0091623 | A1* | 4/2009 | Krogstad | H04N 9/3185 348/189 |
| 2010/0156927 | A1* | 6/2010 | Takase | G09G 3/3413 345/589 |
| 2011/0148904 | A1* | 6/2011 | Kotani | H04N 9/3179 345/589 |
| 2012/0147161 | A1* | 6/2012 | Kim | H04N 13/356 348/58 |
| 2015/0317928 | A1* | 11/2015 | Safaee-Rad | G09G 3/20 345/593 |
| 2020/0098333 | A1* | 3/2020 | Marcu | G09G 5/06 |
| 2020/0210366 | A1* | 7/2020 | Das Sharma | G06F 13/4282 |

* cited by examiner

UBIQUITOUS AUTO CALIBRATION DEVICE AND THE CALIBRATION METHOD THEREOF

FIELD OF THE INVENTION

The present invention is related in a display technology field, more particularly to a ubiquitous auto calibration device to make calibrations for each of various type displays.

BACKGROUND OF THE INVENTION

Presently, all the display devices, such as the display for medical purpose, the general display, the screen wall of using liquid crystal panel or the projection screen, are aimed at displaying colorful images for users. However, the images' color is always inaccurate, and the inaccuracy may make the users uncomfortable when the users are watching the screen. Also, if the display is used for medical purpose, the color difference on the images may have the doctor make a mistaken judgement.

Thus, a standardized image regulation is used to standardize the image color of the above display devices. There are two existing ways in calibrating the display images, and they are hardware adjustment and software adjustment, respectively. The hardware adjustment is to equip the calibration unit in the display device, that is, the display device is equipped with the calibration unit when the display is shipped out from the factory. The software adjustment is to install adjustment software into the computer. After the computer having the adjustment software is connected with the display, the users could use the computer to calibrate the device. Alternatively, install the software into the firmware of the display using a programming method, that is, calibrate the image of the display for the control chip of the display or the motherboard of the display. However, the adjustment device or the adjustment software installed in the firmware of the computer or the display is merely able to calibrate a single and a specific display, and the adjustment methods for various displays are not able to be unified. For example, the adjustment software compatible to the display of brand A is not compatible to the display of brand B.

In addition, there is slight difference between the display panels of different companies, so besides the physical property difference, the maximum brightness is also different. After undergoing a Gamma correction and a color temperature compensation, the brightness difference becomes clearer. For medical organizations with high standards of accurate images and demands of high frequency use, it is highly needed to have displays maintain on the high standards to provide doctors accurate images or data for their judgements.

SUMMARY OF THE INVENTION

According to the existing technical issues, the present invention is mainly to provide a ubiquitous auto calibration device connected with an external display, which may be connected with various type device and the device which is able to output image, wherein no media interface such as computer or software is needed to be used for connection between the ubiquitous auto calibration device and the device which is able to output image. The ubiquitous auto calibration device is able to be applied in all different brands display and any type display for calibrations, so as to solve the technical issues of the image color differences provided by various brand displays, various type displays, or the same type display in the prior arts.

Another object of the present invention is to utilize the outer type ubiquitous auto calibration device to complete a self-adjustment for various displays connected thereof, so as to have the image outputted form the display conform to the standards of the color temperature, the Gamma value, the uniformity and the color gamut.

The other object of the present invention is to allow the outer type ubiquitous auto calibration device to be applied to a display without image calibration, to use the light detecting sensor to detect the optical signal of the display, and to transfer the optical signal to an electrical signal. Using a microcontroller unit to calibrate the electrical signal including red light, green light, blue light and white light signal to have the electrical signal outputted from the display conform to the standards of the color temperature value, the brightness value, the Gamma value, the uniformity and the color gamut value.

As the objects mentioned above, the present invention is to provide An ubiquitous auto calibration device, comprising a microcontroller unit, configured to receive an electrical signal and conduct a self-adjusting process for the electrical signal; a flex bus, connected with the microcontroller unit and transmitting the self-adjusting processed electrical signal to the image processing module; an image receiver, configured to receive an image signal through an image receiving interface; wherein the image processing module is provided for performing an image calibration processing unit, so that the image signal can obey a color temperature standard, a Gamma value, a uniformity and a color gamut standard, when the display outputs the image signal; and an image output unit, connected with the display and configured to transfer the electrical signal calibrated by the self-adjusting process and the image signal calibrated by the ubiquitous auto calibration device to the display, so that the display performs a calibration according to the electrical signal calibrated by the self-adjusting process, and to output the image signal calibrated by the ubiquitous auto calibration device.

DETAILED DESCRIPTION OF THE PREFERRED EMBODIMENT

Figure 1:
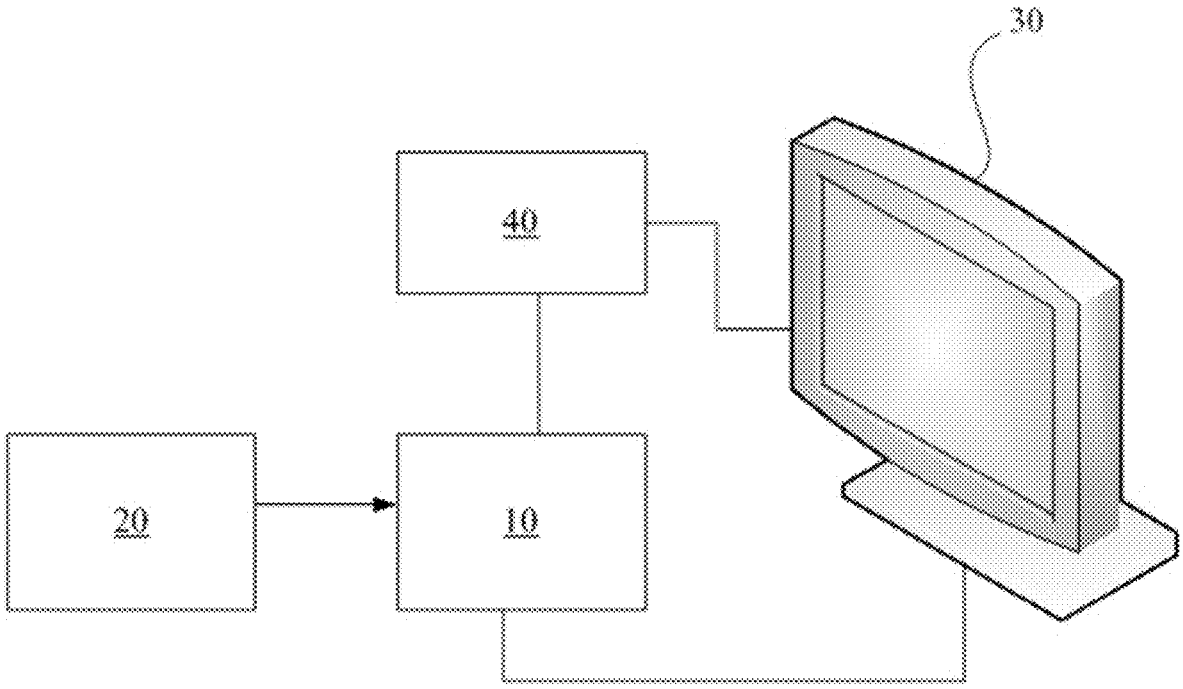
FIG. 1 is a schematic diagram that indicates an embodiment showing the outer type ubiquitous auto calibration device respectively connected with the display and the device which is able to output image in accordance with the technique of the present invention.

FIG. 1 is a schematic diagram that indicates an embodiment showing the outer type ubiquitous auto calibration device respectively connected with the display and the device which is able to output image in accordance with the technique of the present invention. In the FIG. 1, the outer type ubiquitous auto calibration device 10 (hereinafter called ubiquitous auto calibration device 10) connects to the device which is able to output image 20 and the display 30, respectively. The device which is able to output image 20 may be a camera, a mobile phone, a tablet, a projector, a computer or a notebook. The display may be a display device of any brands.

In one embodiment of the present invention, the ubiquitous auto calibration device 10 may connect to the display 30 and the device which is able to output image 20 through a wired method. Take the wired method as an example, the connection between the ubiquitous auto calibration device 10 and the device which is able to output image 20 may select communication terminals such as Serial Digital Interface (SDI), high definition multimedia interface (HDMI), or Video Graphics Array (VGA) to connect each other, so that many connecting ports may be chosen for the terminal of the ubiquitous auto calibration device 10 to reduce the restrictions on matching or selecting the connecting ports. The above connecting methods are well known forms of communication terminals, and they will not be repeated hereinafter.

The above connecting ports may also be used to connect the external ubiquitous auto calibration device 10 and the display 30, so as to reduce the restrictions on matching and selecting the connection port and improve the selectivity for users.

Figure 2:
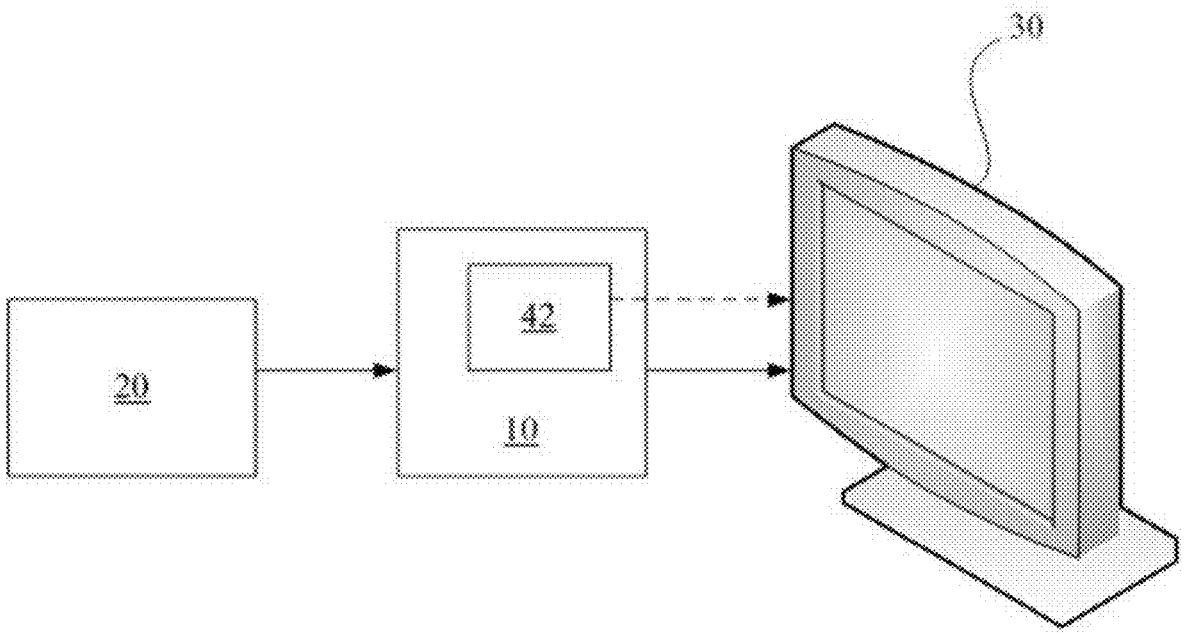
FIG. 2 is a schematic diagram that indicates another embodiment showing the outer type ubiquitous auto calibration device respectively connected with the display and the device which is able to output image in accordance with the technique of the present invention.

In FIG. 1, the ubiquitous auto calibration device 10 further connects to a light detecting sensor 40, and the light detecting sensor is disposed in front of the screen of the display 30 (the panel for image output). In another embodiment, as shown in FIG. 2, the light detecting sensor 42 is built in the ubiquitous auto calibration device 10. No matter the light detecting sensor 40 is an outer connection with the ubiquitous auto calibration device 10 as shown in FIG. 1 or the light detecting sensor 40 is built in the ubiquitous auto calibration device 10, the objects are aimed at detecting the optical signal of the display 30 and transferring the optical signal to electrical signals, wherein the optical signals include the light with wavelengths of red light, green light, blue light and white light. Next, use the microcontroller unit (MCU, as shown in FIG. 3) of the ubiquitous auto calibration device 10 to compute the color temperature value, the brightness value and the Gamma value so as to have the outputted signal of the display 30 conform to the standards of the color temperature value, the brightness value, the Gamma value and the contrast value.

Figure 3:
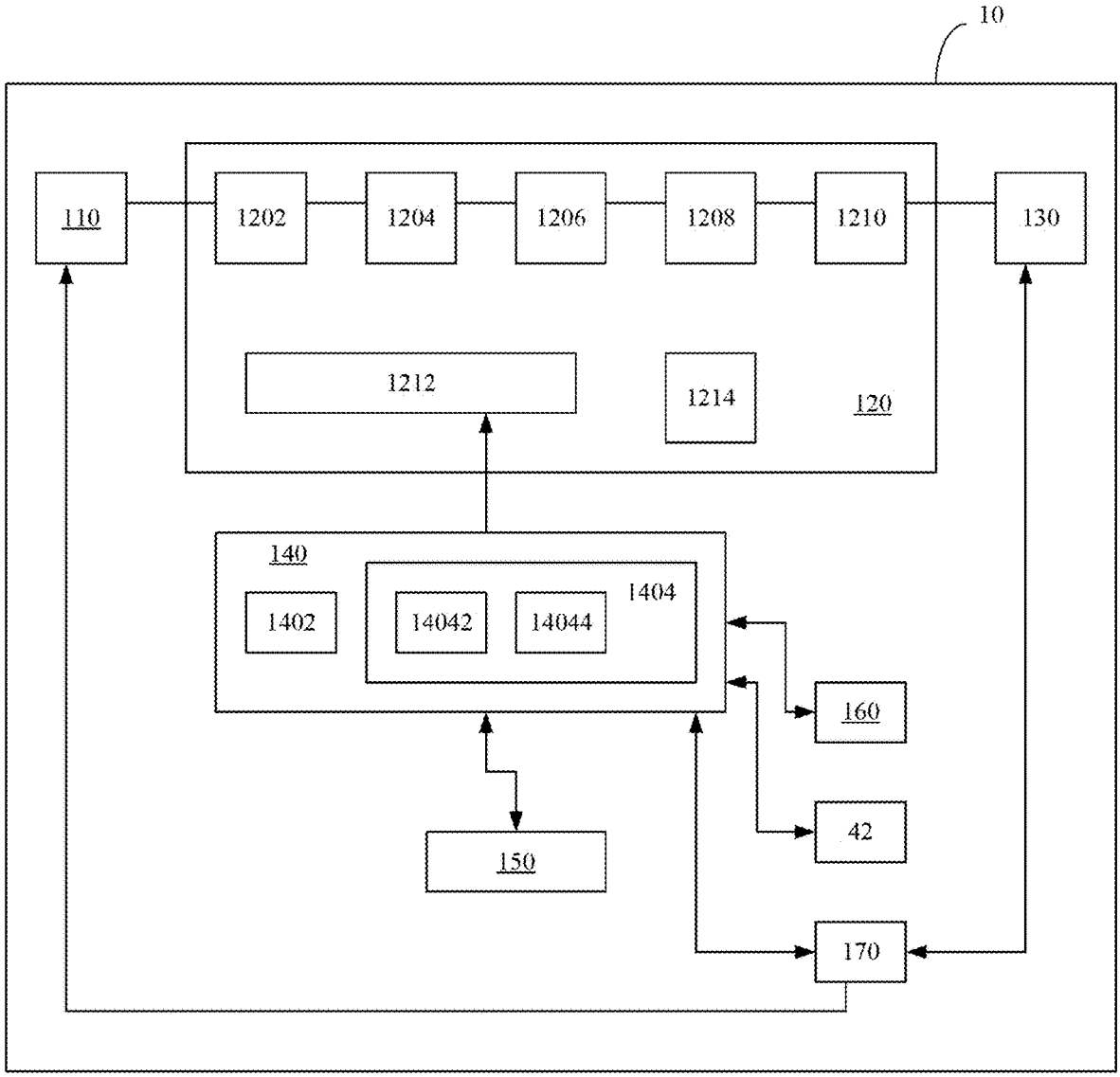
FIG. 3 is a schematic block diagram of the ubiquitous auto calibration device in accordance with the technique of the present invention.

Next, please refer to FIG. 3 and simultaneous see FIG. 1 and FIG. 2. FIG. 3 is a schematic diagram of the ubiquitous auto calibration device in accordance with the technique of the present invention. In FIG. 3, the ubiquitous auto calibration device 10 mainly includes an image receiver 110, an image processing module 120, an image transmitter 130, a microcontroller unit 140, a connecting module 150 and a wireless transmitting module 160. The functions of each module will be demonstrated hereinafter.

The image receiver 110 is used to receive the image signal outputted from the device which is able to output image 20, wherein the device which is able to output image 20 may output the image data from a camera, an endoscope, a video play device, a portable device, a personal computer or a terminal computer, wherein the image data may be in a form of dynamic video or a static photo.

The image processing module 120 is used to receive the image signal transmitted from the image receiver 110 and process the image signal. The image processing module 120 at least includes a Gamma correction unit 1202, a gamut mapping matrix unit 1204, a De Gamma correction unit 1206, a color temperature correction unit 1208, a uniformity correction unit 1210, flex bus 1212 and an on-screen displaying unit 1214. All components described above are electrically connected to each other or connected to each other through signal transmission, but the present invention is not limited herein.

The Gamma correction unit 1202, which also can be called Gamma nonlinearity, Gamma encoding or simply called Gamma. The Gamma correction unit 1202 is used to conduct an operation or a De operation for the luminance or the tristimulus values. After the image signals are calibrated by Gamma correction unit 1202, the image signal will conform to the Gamma standard.

In one embodiment, the Gamut mapping matrix unit 1204 is referred to a specific 3×3 color gamut mapping matrix unit, which means to conduct a gamut mapping for the image signal calibrated by the Gamma correction unit 1202 so as to have the image signal conform to the color gamut standard.

The De Gamma correction unit 1206 is used to linearize the non-linear Gamma curve of the electrical signal from the display to be a linear Gamma curve.

The color temperature correction unit 1208 is used to calibrate the value of the color temperature so that the image signal outputted from the display 30 may conform to the color temperature standard.

The uniformity correction unit 1210 mainly conducts the uniformity of the color temperature and the brightness calibration for the display 30 so that the image data outputted from the display 30 may conform to the standards of the brightness and the color gamut.

The flex bus 1212 is connected with the microcontroller unit 130 and is used to transmit the electrical signal processed by the microcontroller unit 130 to the image processing module 120.

The on-screen displaying unit 1214 is used to adjust the image configuration of the display 30, for example color temperature value, Gamma value, brightness value and contrast value. The users can utilize the on-screen displaying unit 1214 to adjust the image configuration value and to store the value in the memory unit (not shown) of the ubiquitous auto calibration device 10, wherein the memory unit of the ubiquitous auto calibration device 10 may be a Programmable read-only memory (PROM), an Electrically-Erasable Programmable Read-Only Memory (EEPROM) or a flash memory. In addition, the memory unit of the ubiquitous auto calibration device 10 also may storage company's names or serial codes.

The image transmitter 130 is used to transmit the image signal to the display 30.

The microcontroller unit 140 is used to receive the electrical signal transmitted by the light detecting sensor 40 and conduct a self-adjusting process for the electrical signal and process the optical signal and transfer to electrical signal, wherein the electrical signal is obtained through the light detecting sensor 40 (as shown in FIG. 1) externally connected with the ubiquitous auto calibration device 10 or by using the built-in light detecting sensor 42 of the ubiquitous auto calibration device 10 to detect the optical signal of the display 30. In one embodiment of the present invention, the microcontroller unit 140 at least includes an action controller and a calibration controller 1404, wherein the action controller 1402 is used to receive an external input signal and to give instruction and to control self-adjusting process of the ubiquitous auto calibration device 10, wherein the external input signal is inputted from an external device (not shown), such as key board, by users. When the input signal is received by the action controller 1402, the instruction will be provided to control the self-adjusting process of the ubiquitous auto calibration device 10.

The calibration controller 1404 at least includes a calculation function module 14042 and a compensation function module 14044. The calculation function module 14042 transfers the optical signal detected by the light detecting sensors 40, 42 to an electrical signal, and then execute a Gamma correction curve function operation, a color temperature function operation and a color gamut mapping matrix operation. The objects of executing the Gamma correction curve function operation, a color temperature function operation and a color gamut mapping matrix operation for the electrical signal is aimed at mapping the values of above Gamma correction curve, color temperature and color gamut of the display 30 to the Gamma correction curve, color temperature and color gamut of the display that will be inputted image signal.

The compensation function module 14044 conducts the uniformity compensation operation and the De Gamma correction operation for the electrical signals. Similarly, the compensation function module 14044 transfers the optical signal of the display 30 detected by the light detecting sensors 40, 42 and then conducts the uniformity compensation operation and the De Gamma correction operation, so as to have the uniformity of the brightness and the color temperature of the display 30 be able to be corresponding to the uniformity of the brightness and the color temperature outputted by the display 30 and able to calibrate the non-linear curve of the electrical signal to be a Gamma curve to match the linear Gamma curve calibrated by the Gamma correction unit 1206.

The connecting module 150 is used to connect to an external electrical device, wherein the connecting module 150 may be Universal Serial Bus (USB), RJ45 and/or RS232. Please note that the USB port of the ubiquitous auto calibration device may be used to connect with a computer and it may also be an expansion slot connecting with other devices such as a camera, a device or a game console.

The wireless transmitting module 160 is connected with the display 30 or other electronic devices via a wireless method.

Figure 4:
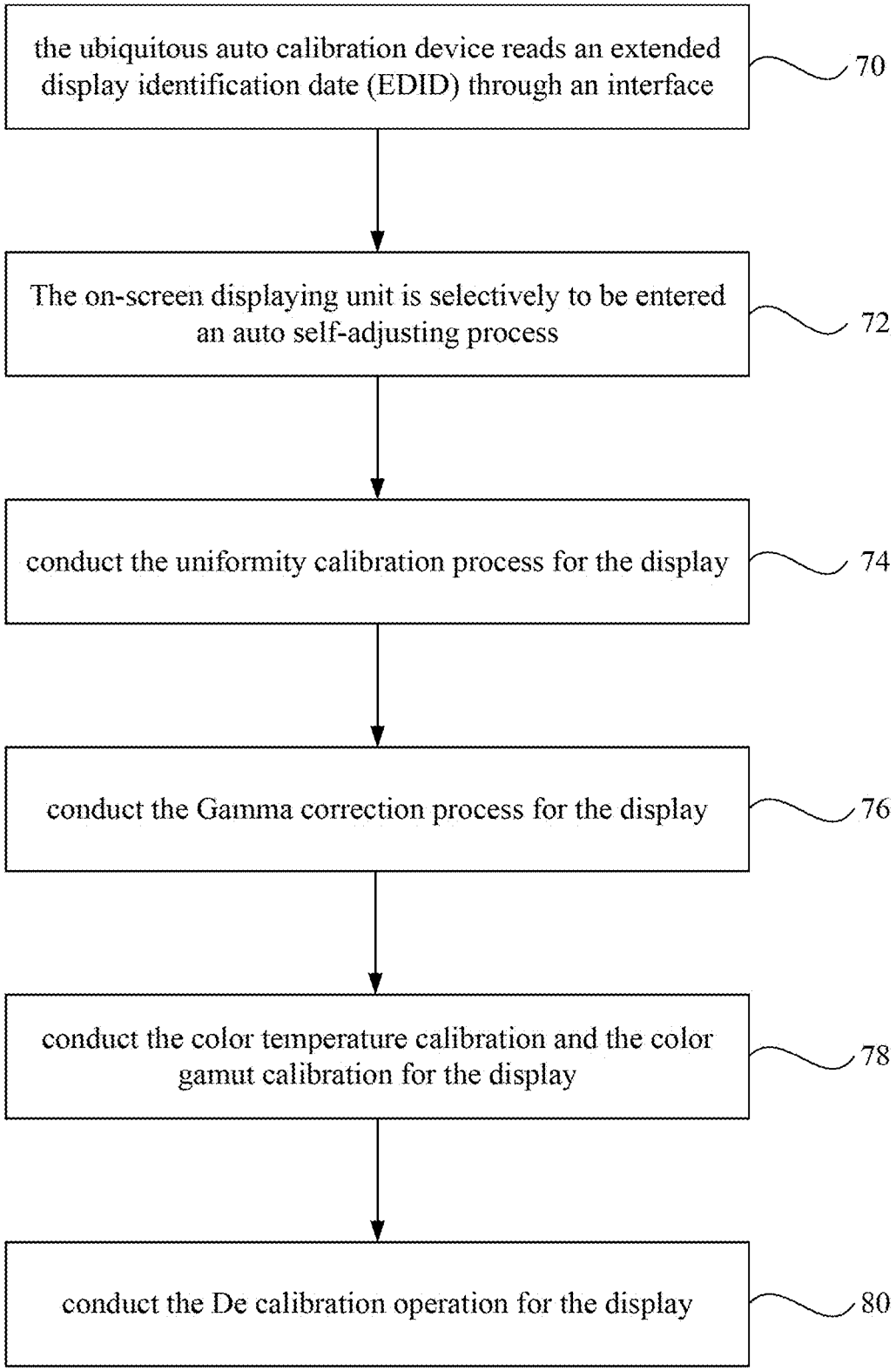
FIG. 4 is a process flow chart indicating the self-adjusting process of the ubiquitous auto calibration device in accordance with the technique of the present invention.

Thus, based on the statements above, please refer to FIG. 4 showing the calibration process of flow the ubiquitous auto calibration device 10. Also, please together refer to FIGS. 1-3, when referring to the process flow of FIG. 4. In FIG. 4, the first step 70: the ubiquitous auto calibration device 10 reads an extended display identification date (EDID) through an interface (not shown). In the step 70, the ubiquitous auto calibration device 10 firstly reads the EDID of display 30 through an interface such as 12G-Serial Digital Interface (12G-SDI) or a display port (DP), and to store the EDID values in the register 170 of the ubiquitous auto calibration device 10, and to transmit the EDID to the device which is able to output image 20 connected with the image receiver 110 of the ubiquitous auto calibration device 10, so as to make image data outputted from the display 30 conform to the resolution of the display 30.

In the step 72: The on-screen displaying unit 1214 is selectively to be entered an auto self-adjusting process.

In the step 74: conduct the uniformity calibration process for the display 30.

In the step 76: conduct the Gamma correction process for the display 30.

In the step 78: conduct the color temperature calibration and the color gamut calibration for the display 30.

In the step 80: conduct the De calibration operation for the display 30.

Figure 6:
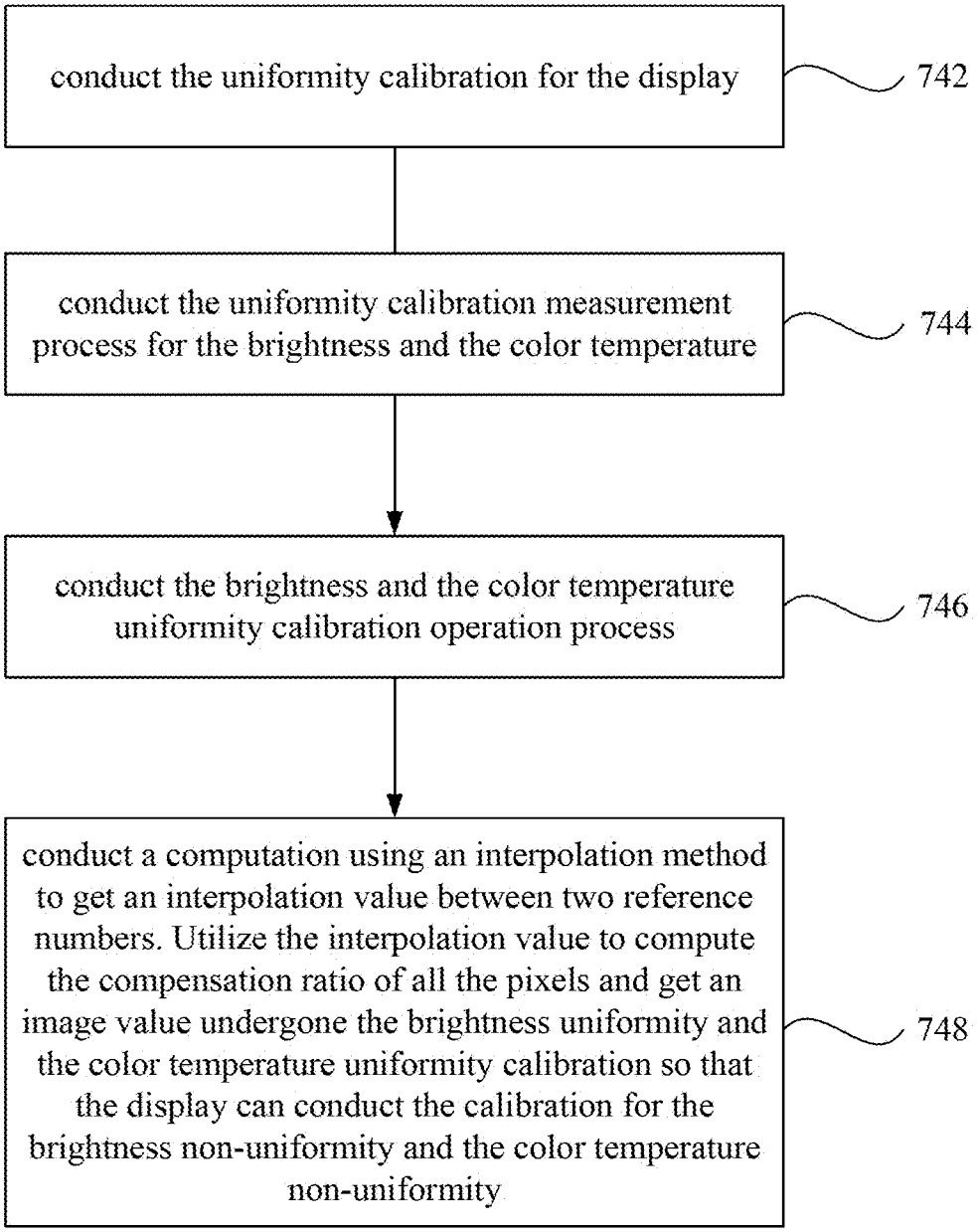
FIG. 6 is a process flow chart indicating that the display conducts the uniformity calibration for each process.

Please continue to refer to FIG. 6. FIG. 6 is a further explanation for the uniformity calibration process in the step 74.

Figure 5A:
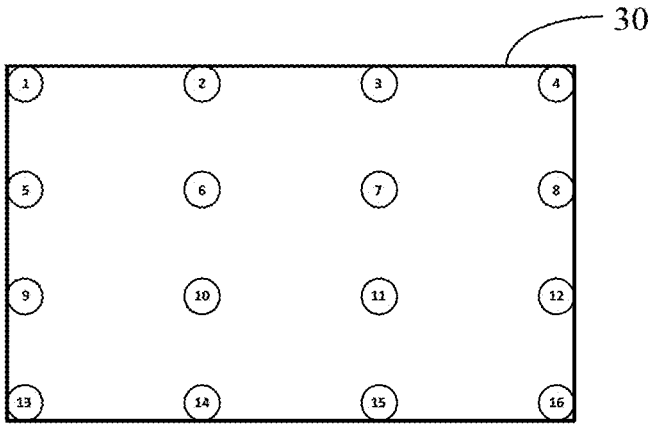
FIG. 5A is a schematic diagram indicating that the 16 measurement points are defined by the resolution of the display in accordance with the technique of the present invention.
Figure 5B:
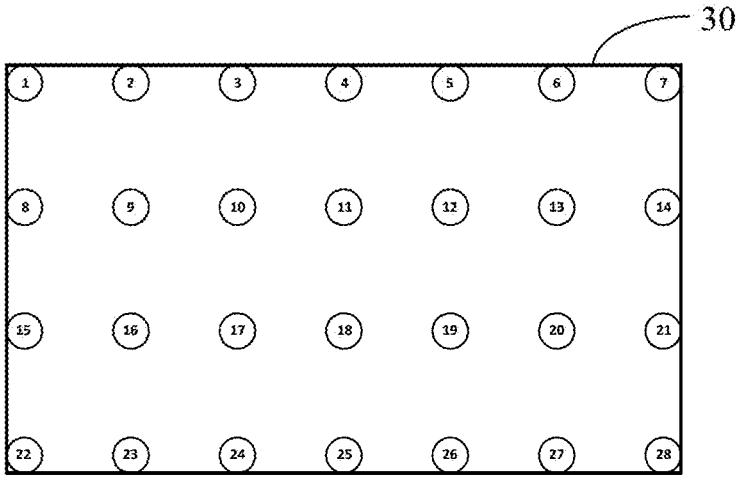
FIG. 5B is a schematic diagram indicating that the 28 measurement points are defined by the resolution of the display in accordance with the technique of the present invention.

The step 742: conduct the uniformity calibration for the display. In this step, the uniformity correction unit 1210 is used to achieve the object, and the object is to solve the problems caused by the image uniformity of the display 30 due to the backlight luminance and the color temperature uniformity. In this step, the uniformity correction unit 1210 defines 16 or 28 measurement points on the display screen according to the resolution of the display 30, wherein the minimum of resolution may be 640×480 and the maximum of resolution may be 4K×2K. When the resolution is less than or equal to 2560×2048, the uniformity correction unit 1210 defines 16 measurement points on the display screen of the display 30, as shown in FIG. 5A. In another embodiment, when the resolution is higher than 2560×2048, the uniformity correction unit 1210 defines 28 measurement points on the display screen of the display 30, as shown in FIG. 5B.

Figure 7:
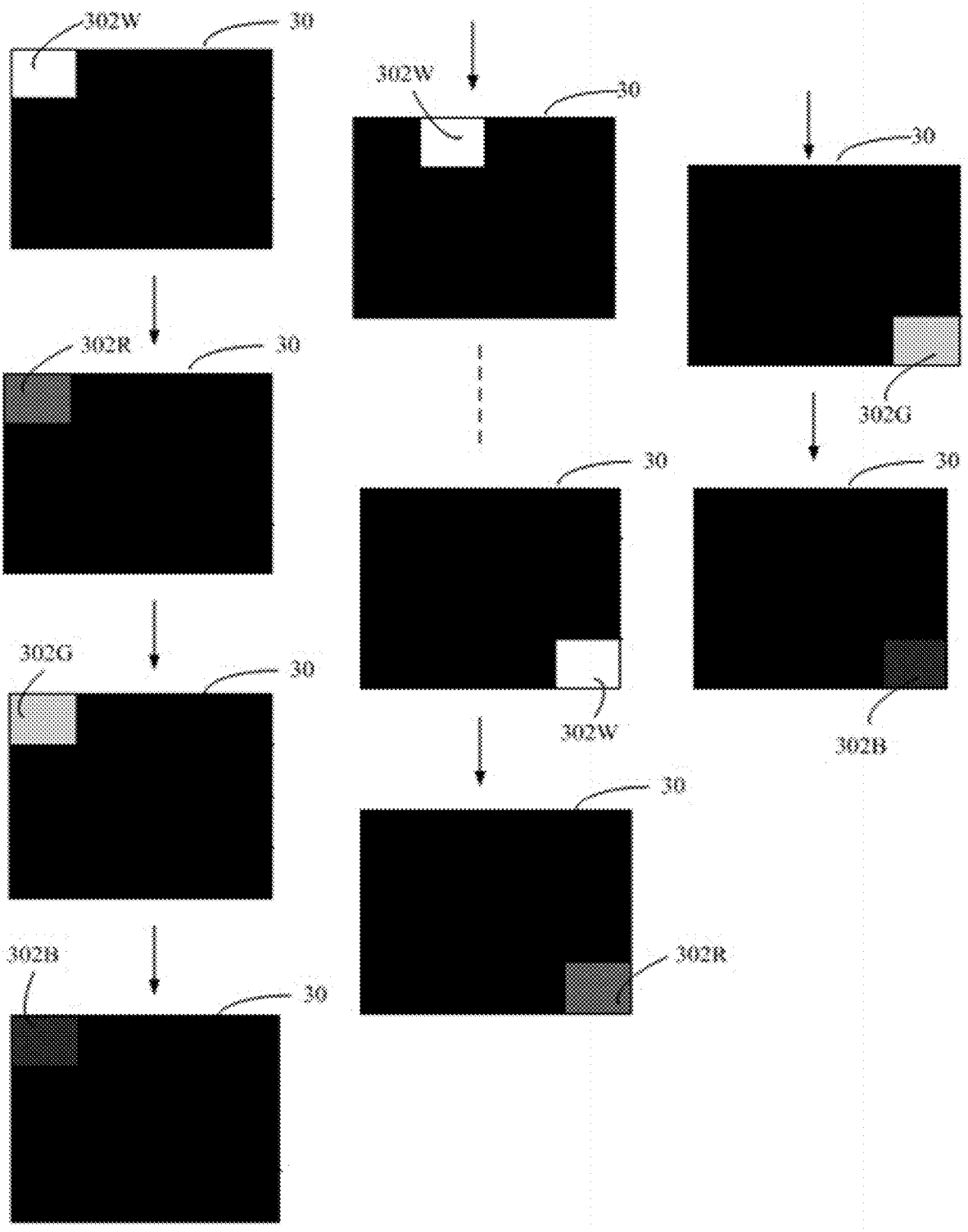
FIG. 7 is a schematic diagram indicating that during the calibration process of the brightness and chroma uniformity, the blocks of each of the points show a complete white image, a complete red image, a complete green image and a complete blue image in accordance with the technique of the present invention.

In the step 744: conduct the uniformity calibration measurement process for the brightness and the color temperature. First, conduct the uniformity calibration step: to transmit a whole black image to the display 30 to have the display 30 be complete black, as shown in FIG. 7. FIG. 7 shows a complete white measurement block 302W on the spot of reference number 1 of FIG. 5A or FIG. 5B, and the RGB value of the complete white measurement block is (4096, 4096, 4096). At this moment, align the light detecting area of the external or the built-in light detecting sensors 40, 42 to the block, and then the on-screen displaying unit 1214 will lead the latter process. The light detecting sensors 40, 42 detect the measurement values, and the measurement block will sequentially move from reference number 1 of FIG. 5A or FIG. 5B to reference number 2, repeating the complete white block 302W, the complete red block 302R, the complete green block 302G and the complete blue block 302B. According to the displaying sequence, after the cycle of showing the complete white block 302W, the complete red block 302R, the complete green block 302G and the complete blue block 302B is finished, the next reference number block will start to be measured until the end number, reference number 16 or reference number 28, as shown in FIG. 7.

Next, continue to the step 746: conduct the brightness and the color temperature uniformity calibration operation process. In this step, the display with resolution of 2560×2048 and 16 measurement points is taken for an example. First, for the issues of the brightness non-uniformity and the color temperature non-uniformity of the display 30, use the light detecting sensors 40, 42 to define 16 measurement points on the screen of the display 30 through the uniformity correction unit 1210. The 16 measurement points include the four brightness values of each block, wherein the four brightness values are there in red block, green block, blue block and white block respectively, so that the ultimately target value can be determined. The target brightness can be a maximum brightness, an average brightness or a minimum brightness. In the case that the minimum brightness is the target brightness, the calibration method is taken to compute the minimum brightness, and the formula is given by: target brightness=(minimum brightness×100)/95 Eq(1). After the computation using the equation (1), the error value of the average brightness higher than 95% obtains the ratio correlation between the regional brightness and the target brightness and the regional color temperature and the target color temperature, which is given by: {1−[(Lmax−Lmin)/Lmax]}>95% Eq (2), wherein Lmax is the maximum brightness of the 16 measurement points and Lmin is the minimum brightness of the 16 measurement points.

Next, the step 748: conduct a computation using an interpolation method to get an interpolation value between two reference numbers. Utilize the interpolation value to compute the compensation ratio of all the pixels and get an image value undergone the brightness uniformity and the color temperature uniformity calibration so that the display can conduct the calibration for the brightness non-uniformity and the color temperature non-uniformity. In the step, conducting an interpolation operation by computing the brightness values of each reference number of FIG. 5A or FIG. 5B, an interpolation value of two reference number can be obtained, wherein the computation method may be the vertical cubic spline interpolation method. Thus, the amount of the interpolation value of the brightness values measured from the blocks of the reference number 1 and the reference number 5 is 683, from the blocks of the reference number 2 and the reference number 6, is 682, from the blocks of the reference number 6 and reference number 10, is 682, so and so forth. For other number of the interpolation value, it is also obtained using the Cubic spline interpolation method, so the number of 4×2048 interpolation values can be obtained. Similarly, compute the blocks of reference number 1 and reference number 2 using the cubic spline interpolation method, the amount of the interpolation value is 426, so and so forth, and the amount of interpolation values of 1280×1280 can be obtained, wherein the interpolation equations from Eq (3) to Eq (14) of the reference number of the each RGB are given by:

The equation of interpolation method of R for reference number 1:

$$U(Ri)=R_A1_x^3+R_B1_x^2+R_C1_x+R_D1, \quad \text{Eq(3)}$$

The equation of interpolation method of R for reference number 2:

$$U(Ri)=R_A2_x^3+R_B2_x^2+R_C2_x+R_D2, \quad \text{Eq(4)}$$

The equation of interpolation method of R for reference number 3:

$$U(Ri)=R_A3_x^3+R_B3_x^2+R_C3_x+R_D3, \quad \text{Eq(5)}$$

The equation of interpolation method of R for reference number 4:

$$U(Ri)=R_A4_x^3+R_B4_x^2+R_C4_x+R_D4, \quad \text{Eq(6)}$$

The equation of interpolation method of G for reference number 1:

$$U(Gi)=G_A1_x^3+G_B1_x^2+G_C1_x+G_D1, \quad \text{Eq(7)}$$

The equation of interpolation method of G for reference number 2:

$$U(Gi)=G_A2_x^3+G_B2_x^2+G_C2_x+G_D2, \quad \text{Eq(8)}$$

The equation of interpolation method of G for reference number 3:

$$U(Gi)=G_A3_x^3+G_B3_x^2+G_C3_x+G_D3, \quad \text{Eq(9)}$$

The equation of interpolation method of G for reference number 4:

$$U(Gi)=G_A4_x^3+G_B4_x^2+G_C4_x+G_D4, \quad \text{Eq(10)}$$

The equation of interpolation method of B for reference number 1:

$$U(Bi)=B_A1_x^3+B_B1_x^2+B_C1_x+B_D1, \quad \text{Eq(11)}$$

The equation of interpolation method of B for reference number 2:

$$U(Bi)=B_A2_x^3+B_B2_x^2+B_C2_x+B_D2, \quad \text{Eq(12)}$$

The equation of interpolation method of B for reference number 3:

$$U(Bi)=B_A3_x^3+B_B3_x^2+B_C3_x+B_D3, \quad \text{Eq(13)}$$

The equation of interpolation method of B for reference number 4:

$$U(Bi)=B_A4_x^3+B_B4_x^2+B_C4_x+B_D4, \quad \text{Eq(14)}$$

For other reference numbers, the interpolation method is also used to find each interpolation value.

Next, the compensation ratio value in total amount of 1280×1280 is computed according to the cubic spline interpolation method. Each of two pixel uses one compensation ratio value, wherein one compensation ratio value contains three sub pixel's compensation ratio values and the three sub pixel's compensation ratio values are the compensation ratio values of R, G and B. Transmit the image value, which is obtained by taking the compensation ratio value and inputted image into computation and undergoing brightness and color temperature uniformity calibration, to the display 30 through the display 30, so as to calibrate the brightness uniformity and the color temperature uniformity of the display 30, wherein the equations for the computation of the image value are given by:

$$\text{Pixel } R \text{ Data Out}=\text{Pixel } R \text{ Data In}\times U(Ri), i \text{ means the } i^{th} \text{ pixel}, \quad \text{Eq (15)}$$

Pixel $G$ Data Out=Pixel $G$ Data In×$U(Gi)$,$i$ means the $i^{th}$ pixel, Eq (16)

Pixel $B$ Data Out=Pixel $B$ Data In×$U(Bi)$,$i$ means the $i^{th}$ pixel, Eq (17)

Figure 8:
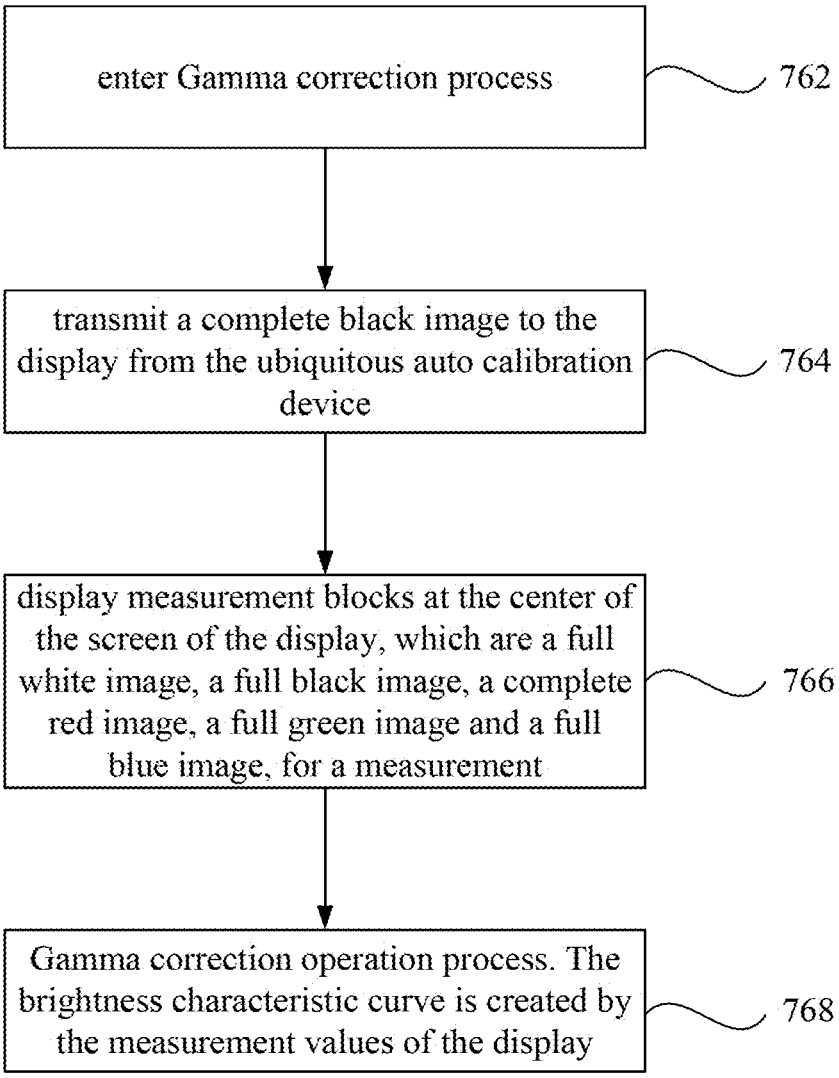
FIG. 8 is a process flow chart indicating a further process of conducting Gamma correction in accordance the technique of the present invention.

Next, in the above step 76: A further explanation that the ubiquitous auto calibration device conducts a calibration process for the display 30 is made. The objective of this step is to have the display 30 conform to the Gamma norm, such as Gamma curves of Gamma 1.8, Gamma 2.0, Gamma 2.2, Gamma 2.4 or Gamma DICOM. FIG. 8 is used to provide a further explanation for the step 76, which indicates a further process flow chart of conducting Gamma correction for the display 30. The step 762: enter Gamma correction process. The step 764: transmit a complete black image to the display 30 from the ubiquitous auto calibration device. The step 766: display measurement blocks at the center of the screen of the display 30, which are a full white image, a full black image, a complete red image, a full green image and a full blue image, for a measurement. The RGB value of the full white image is (4096, 4096, 4096). At this moment, it is needed to align the detecting area of the light detecting sensors 40, 42 to the full white block, and the RGB value (0, 0, 0), the full white block, will be gradually increased, that is, the RGB value will be increased from RGB(0, 0, 0) to RGB(64, 64, 64), RGB(128, 128, 128) till RGB(4096, 4096, 4096), the so-called 64 color level variation of white color. Thus, as mentioned above, the 64 color level variation of red color increases from RGB(0, 0, 0) to RGB(64, 0, 0), RGB(128, 0, 0) then gradually till RGB(4096, 0, 0). The 64 color level variation of green color is increased from RGB(0, 0, 0) to RGB(0, 64, 0), RGB(0, 128, 0) then gradually till RGB(0, 4096, 0). The 64 color level variation of blue color is increased from RGB(0, 0, 0) to RGB(0, 0, 64), RGB(0, 0, 128) then gradually till (0, 0, 4096). The sequence ends.

Figure 9:
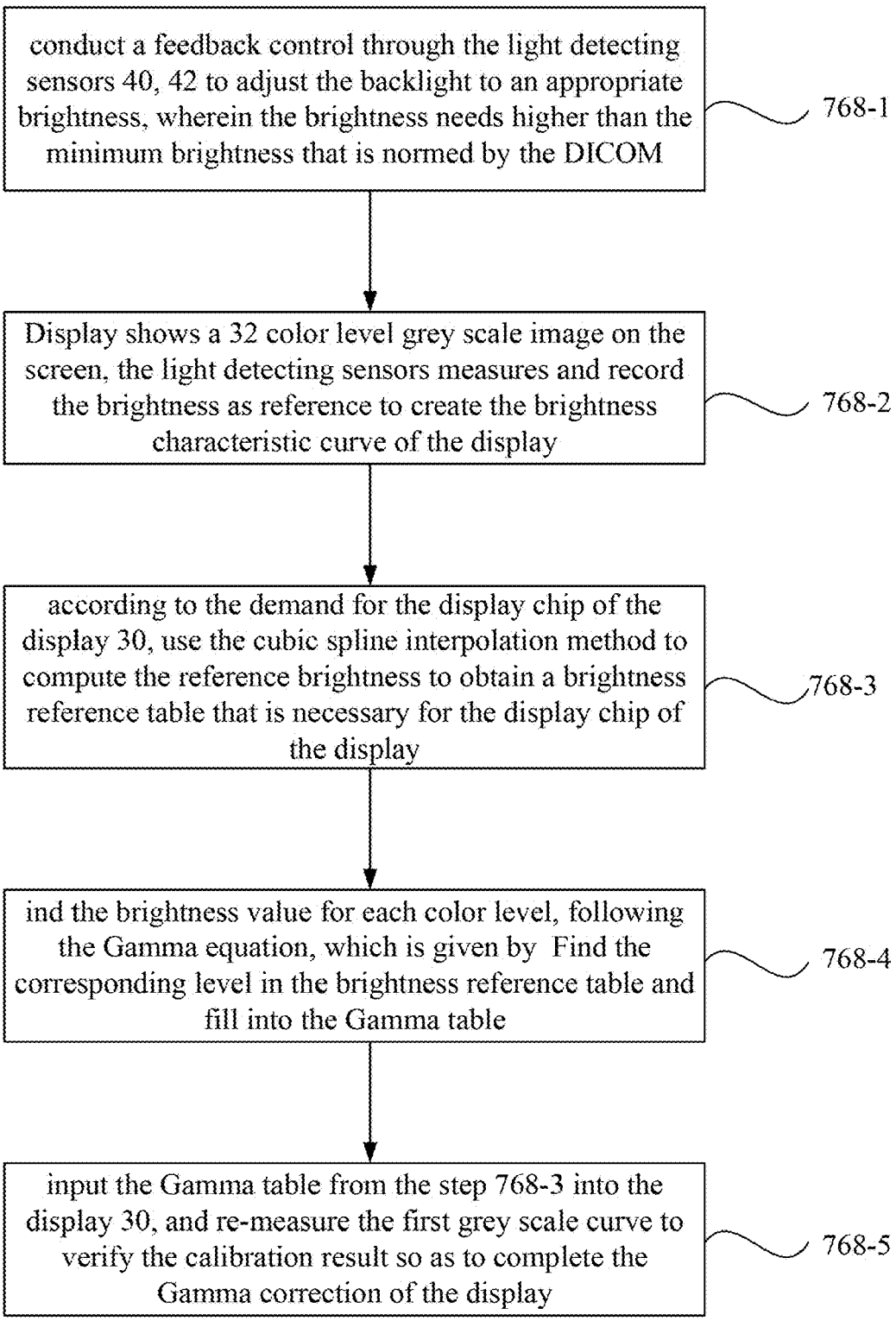
FIG. 9 is a process flow chart indicating a further process of conducting Gamma correction operating process in accordance the technique of the present invention.

Next, the step 768: Gamma correction operation process. The brightness characteristic curve is created by the measurement values of the display. The process flow of the step 768 is shown in FIG. 9, comprising:

The step 768-1: conduct a feedback control through the light detecting sensors 40, 42 to adjust the backlight to an appropriate brightness, wherein the brightness needs higher than the minimum brightness that is normed by the DICOM.

The step 768-2: Display 30 shows a 32 color level grey scale image on the screen, the light detecting sensors 40, 42 measures and record the brightness as reference to create the brightness characteristic curve of the display 30.

The step 768-3: according to the demand for the display chip of the display 30, use the cubic spline interpolation method to compute the reference brightness to obtain a brightness reference table that is necessary for the display chip of the display 30.

The step 768-4: find the brightness value for each color level, following the Gamma equation, which is given by Eq(18). Find the corresponding level in the brightness reference table and fill into the Gamma table.

$$L(x) = L_0 + (L_{n-1} - L_0) \times \left(\frac{x}{n}\right)^r, \quad \text{Eq(18)}$$

wherein x=0.1, . . . n−1, and n is the magnitude of the brightness reference table.

The step 768-5: input the Gamma table from the step 768-3 into the display 30, and re-measure the first grey scale curve to verify the calibration result so as to complete the Gamma correction of the display 30.

Figure 10:
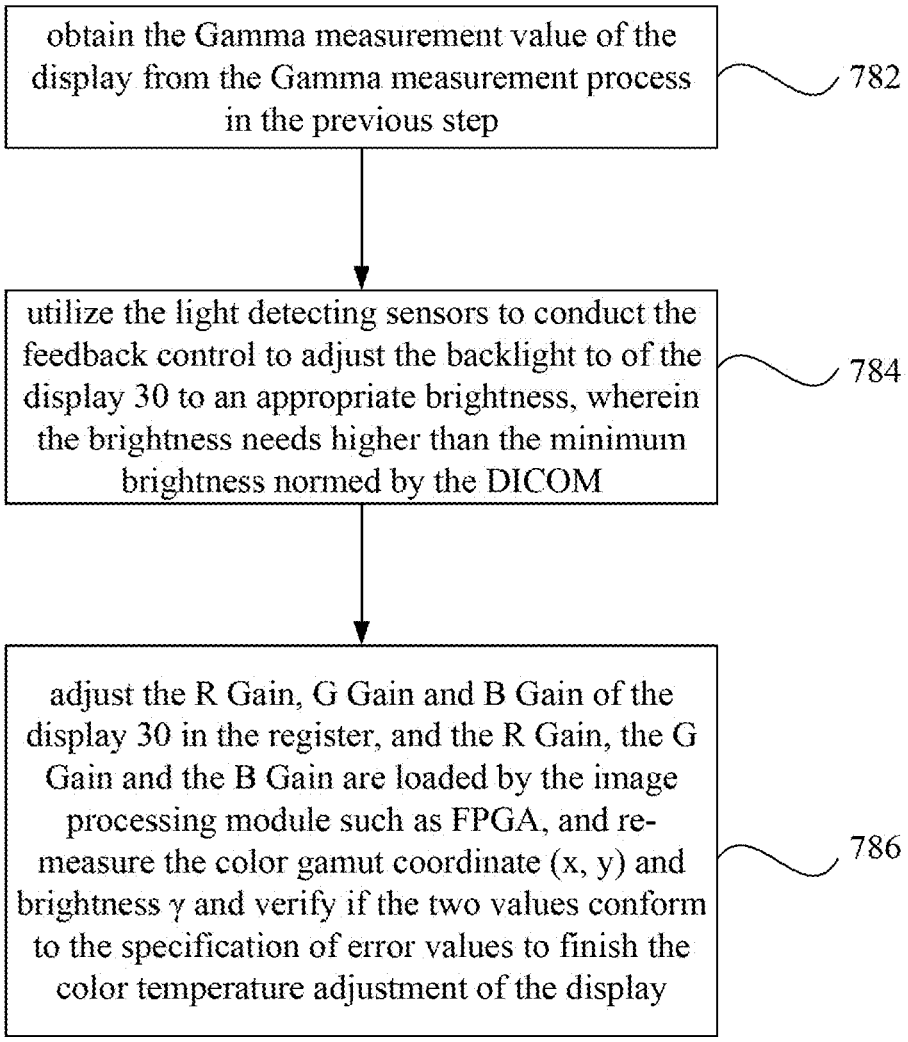
FIG. 10 is a process flow chart indicating a further process of conducting a color temperature calibrating operation for the display in accordance the technique of the present invention.

Next, in the step 78: a further explanation of conducting the color temperature and the color gamut calibration process. In the process 78: the object that the ubiquitous auto calibration device 10 conducts the color temperature and the color gamut calibration process for the display 30 is to have the output image of the display 30 conform to the color temperature specification, wherein the color temperature may be 5400K, 6500K, 7300K, 8200K or 9300K etc. A further process of the step 78 is demonstrated in FIG. 10, comprising:

The step 782: obtain the Gamma measurement value of the display 30 from the Gamma measurement process in the previous step.

In the step 784: utilize the light detecting sensors 40, 42 to conduct the feedback control to adjust the backlight to of the display 30 to an appropriate brightness, wherein the brightness needs higher than the minimum brightness normed by the DICOM.

The step 786: adjust the R Gain, G Gain and B Gain of the display 30 in the register, and the R Gain, the G Gain and the B Gain are loaded by the image processing module such as FPGA, and re-measure the color gamut coordinate (x, y) and brightness γ and verify if the two values conform to the specification of error values to finish the color temperature adjustment of the display 30. The display 30 displays a complete white testing image. The current color gamut coordinate (x, y) and the current brightness γ of the display 30 are measured through the light detecting sensors 40, 42 using the mapping matrix. The R Gain, G Gain and B Gain of the display 30 of the register, wherein R gain is proportional to the "x" of the (x, y) coordinate of the color temperature system, G Gain is proportional to the "y" and B Gain is inversely proportional to the x and y. In addition, the correlation between R Gain, G Gain, B Gain and the brightness of the display 30 is given by:

$$\gamma = 0.299 \times R\ \text{Gain} + 0.587 \times G\ \text{Gain} + 0.114 \times B\ \text{Gain}, \quad \text{Eq(19)}$$

Figure 11:
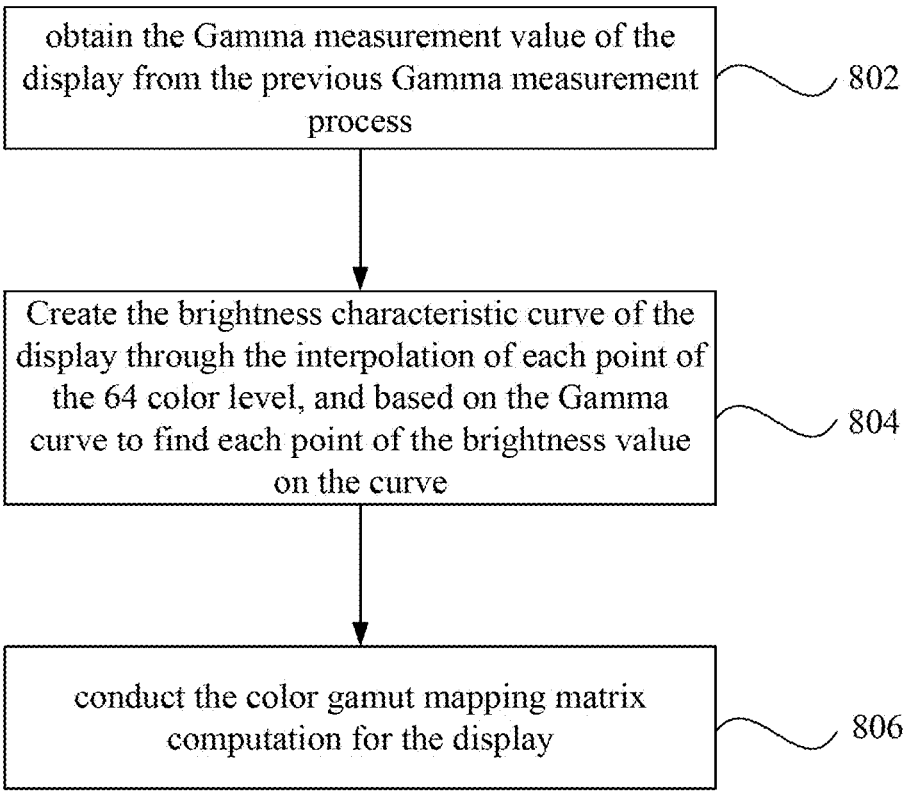
FIG. 11 is a process flow chart indicating a process of conducting a De Gamma calibrating operation for the display in accordance the technique of the present invention.

In the step 80: conduct a De Gamma correction operation for the display. Since the Gamma curve in the display 30 usually is nonlinear, to linearize the Gamma curve of the display 30 is to calibrate the display 30 and get a linear Gamma curve, wherein the step 80 is used to further explain the process flow as shown in FIG. 11.

The step 802: obtain the Gamma measurement value of the display 30 from the previous Gamma measurement process.

The step 804: Create the brightness characteristic curve of the display 30 through the interpolation of each point of the 64 color level, and based on the Gamma curve to find each point of the brightness value on the curve.

Figure 12:
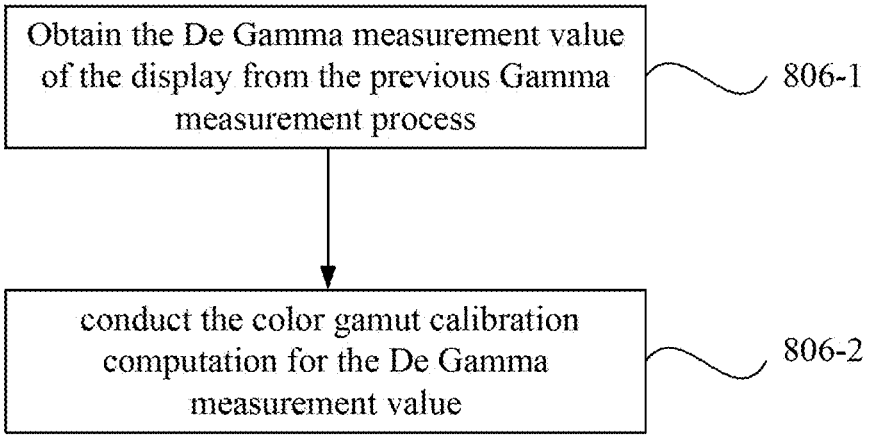
FIG. 12 is a further process flow chart indicating the process of conducting a color gamut mapping matrix operation for the display in accordance the technique of the present invention.

The step 806: conduct the color gamut mapping matrix computation for the display 30. The object of the step is aimed at having a conforming output image of the color gamut for the display. For example, standard red green blue color space (sRGB), Adobe RGB, Rec.709、Rec.2020、SMPTE-C or DCI color gamut regulated by the International Telecommunication Union, wherein the step 806 further includes the process flow shown in FIG. 12.

The step 806-I: Obtain the De Gamma measurement value of the display 30 from the previous Gamma measurement process.

The step 806-2: conduct the color gamut calibration computation for the De Gamma measurement value, following the equation (20), which is given by:

$$\begin{matrix} R' \\ [G'] = \\ B' \end{matrix} \begin{matrix} a11 & q12 & a13 \\ [a21 & a22 & a23]\}, \\ a31 & a32 & a33 \end{matrix} \quad \text{Eq(20)}$$

Based on the matrix of Eq(20), Eq(21) is derived.

$$\begin{aligned} R' &= a11R + a12G + a13B \\ G' &= a21R + a22G + a23B \\ B' &= a31R + a32G + a33B, \end{aligned} \quad \text{Eq(21)}$$

Therefore, after the optical signal detected by the light detecting sensors 40, 42 of the display 30 in the present invention is transferred to the electrical signal and the display 30 conducts the self-adjusting process for the ubiquitous auto calibration device 10, the image data outputted from the display 30 will conform to the standards of the color temperature, the Gamma value, the uniformity and the color gamut. In addition, the ubiquitous auto calibration device 10 of the present invention is able to be applied in the displays 30 of any brands. Since the ubiquitous auto calibration device 10 adjusts the individual values of the color temperature, the Gamma value, the uniformity and the color gamut, the image data will not show an over deep or over light color and/or grey scale resulting from different brands of the displays 30, after the display 30 is calibrated. This also could help the users to have the same color temperature, the same Gamma value, the uniformity and the color gamut image data, when they input the same image data to different brand displays 30, such as View Sonic or Sony.

What is claimed is:

1. A ubiquitous auto calibration device, comprising:

at least one light detecting sensor, configured to detect an optical signal of a display and transfer the optical signal to an electrical signal;

a microcontroller unit, comprising a calculation function module, a compensation function module and an action controller configured to receive the electrical signal and conduct a self-adjusting process for the electrical signal, and the action controller is provided for receiving an external input signal and execute an action instructed by the external input signal, the self-adjusting process comprising a Gamma correction curve function operation, a color temperature function operation and a color gamut mapping matrix operation executed by the calculation function module, and a De Gamma correction operation and a uniformity compensation operation executed by the compensation function module;

a flex bus, connected with the microcontroller unit, and configured to transmit the self-adjusting processed electrical signal to an image processing module;

an image receiver, configured to receive an image signal through an image receiving interface;

wherein the image processing module, comprising a Gamma correction unit, a Gamut mapping matrix unit, a De Gamma correction unit, a color temperature correction unit, a uniformity correction unit and an on-screen displaying unit, is provided for performing an image calibration process, wherein the Gamma correction unit is configured to conduct an operation or a De operation of a luminance and/or a tristimulus values for the image signal, the Gamut mapping matrix unit is configured to conduct a color gamut mapping matrix operation for the image signal calibrated by the Gamma correction unit, the De Gamma correction unit is configured to linearize a non-linear Gamma curve of the electrical signal calibrated by the self-adjusting process so as to calibrate the non-linear curve of the electrical signal to be a Gamma curve to match a linear Gamma curve calibrated by the Gamma correction unit, the color temperature correction unit is configured to conduct the color temperature function operation to adjusting gain values of R, G and B based on a brightness value of the display, and the uniformity correction unit is configured to conduct a uniformity calibration process, so that a uniformity of a brightness and the color temperature of the display is corresponding to the uniformity of the brightness and the color temperature of the image signal outputted to the display, and the image signal can obey a color temperature standard, a Gamma value, a uniformity and a color gamut standard, when the display outputs the image signal; and an image output unit, connected with the display and configured to transfer the electrical signal calibrated by the self-adjusting process and the image signal calibrated by the ubiquitous auto calibration device to the display, so that the display performs a calibration according to the electrical signal calibrated by the self-adjusting process, and to output the image signal calibrated by the ubiquitous auto calibration device;

wherein the uniformity calibration process of the image processing module includes:

defining a plurality of measurement points on a display screen according to a resolution of the display;

transmitting a whole black image to the display to show a block with complete black;

aligning a light detecting area of the light detecting sensor to the block;

the on-screen displaying unit controls the display to repeatedly show a complete white block, a complete red block, a complete green block, and a complete blue block at the plurality of measurement points;

detecting four brightness values of the complete white block, the complete red block, the complete green block, and the complete blue block at each of the measurement point; and deciding a maximum brightness, an average brightness or a minimum brightness value from the detected brightness values, and calibrating to form a target brightness value based on the maximum brightness, the average brightness or the minimum brightness value;

and the uniformity compensation operation of the microcontroller unit includes:

computing a interpolation of the detected brightness value at each of the measurement point to get an interpolation value between two measurement points; and obtaining a compensation ratio values of R, G and B by computing a cubic spline interpolation of the color temperature based on the interpolation value.

2. The ubiquitous auto calibration device of claim 1, wherein the light detecting sensor is built in the ubiquitous auto calibration device or externally connected with the ubiquitous auto calibration device.

3. The ubiquitous auto calibration device of claim 1, wherein the image signal is provided from the group consisting of a camera, an endoscope, a video play device, a portable device, a personal computer and a terminal computer.

4. The ubiquitous auto calibration device of claim 1, wherein the external input signal is generated by an external device.

5. The ubiquitous auto calibration device of claim 1, wherein the external device is a keyboard.

6. The ubiquitous auto calibration device of claim 1, further comprising a connecting module connected with an external electrical device, wherein the connecting module is a USB terminal, an RJ45 terminal and/or an RS232 terminal.

7. The ubiquitous auto calibration device of claim 1, further comprising a flash memory, configured to store the brightness value and/or a contrast value corresponding to the color temperature standard, the Gamma value, the uniformity and the color gamut standard of the resolution of the display.

* * * * *